US005720107A

United States Patent [19]

Rolf et al.

[11] Patent Number: 5,720,107

[45] Date of Patent: Feb. 24, 1998

[54] ADJUSTABLE PULSATOR

[75] Inventors: Wilfried Rolf, Runkel-Eschenau; Karl Herzog, Frankfurt, both of Germany

[73] Assignee: Braun Aktiengesellschaft, Frankfurt, Germany

[21] Appl. No.: 663,246

[22] PCT Filed: Nov. 5, 1994

[86] PCT No.: PCT/EP94/03639

§ 371 Date: Jul. 25, 1995

§ 102(e) Date: Jul. 25, 1995

[87] PCT Pub. No.: WO95/17113

PCT Pub. Date: Jun. 29, 1995

[30] Foreign Application Priority Data

Dec. 23, 1993 [DE] Germany ..... 43 44 109.2

[51] Int. Cl.[6] ..... A45D 00/00

[52] U.S. Cl. ..... 34/97

[58] Field of Search ..... 34/96, 97

[56] References Cited

U.S. PATENT DOCUMENTS

| | | | |
|---|---|---|---|
| 4,019,260 | 4/1977 | Levy et al. | 34/97 |
| 4,132,360 | 1/1979 | Lee, Jr. | 239/383 |
| 4,295,283 | 10/1981 | Tomaro | 34/97 |
| 5,392,528 | 2/1995 | McDougall | 34/97 |

FOREIGN PATENT DOCUMENTS

| | | |
|---|---|---|
| 1 183 345 | 3/1985 | Canada . |
| 0441752 | 8/1991 | European Pat. Off. . |
| 0487932 B1 | 6/1992 | European Pat. Off. . |
| 0487933 | 6/1992 | European Pat. Off. . |
| 0503210 | 9/1992 | European Pat. Off. . |
| 680 978 | 12/1992 | Switzerland . |
| 682293 | 8/1993 | Switzerland . |

*Primary Examiner*—Henry A. Bennett
*Assistant Examiner*—Dinnatia Doster
*Attorney, Agent, or Firm*—Edward S. Podszus

[57] ABSTRACT

The invention is directed to an air-moving pulsator (12) for an electric hair dryer (10) which, for the purpose of creating a pulsing action in the air stream, includes a rotor (20, 41) rotatably supported in a substantially tubular housing portion (13) and having an impeller (11) adapted to be impacted by the air stream exiting from the hair dryer (10), wherein there is arranged upstream of the rotor (20, 41), as seen when looking in the discharge direction of the air stream, a stator (38) provided with selectively moveable vanes for varying the pulsation frequency and adapted to impart rotation to the air stream about its axis. In a preferred embodiment, stator (38) is provided with air-directing blades (28) pivotally mounted on radially oriented spokes (26), and the air-directing blades (28) carry cam follower pins (31) at the ends of arms (29). A cam ring (32) is rotatably secured by outer ring (33) on the housing portion (13) and has helical camming slots (36) to cam the pins (31).

31 Claims, 5 Drawing Sheets

ADJUSTABLE PULSATOR

BACKGROUND OF THE INVENTION

This invention relates to an air-moving pulsator for an electric hair dryer which, for the purpose of creating a pulsing action in the air stream, includes a rotor rotatably supported in a substantially tubular housing portion and having an impeller adapted to be impacted by the air stream exiting from the hair dryer.

BACKGROUND

A pulsator of this type is known from DE 32 25 944 A1. (which corresponds to Canadian Application 1 183 345) This pulsator includes a rotor mounted coaxially with the air outlet of the hair dryer housing and including a plurality of parallel vanes as well as one vane arranged at right angles to these vanes. In this arrangement, the parallel vanes are of approximately like inclination, whereas the vane disposed perpendicular thereto is inclined in opposite directions on opposite sides of the axis of rotation. When the air stream exiting from the hair dryer impinges upon one of the inclined surfaces of the perpendicularly arranged vane, rotation is imparted to the rotor, with the parallel vanes then creating a swirl in the exiting air stream. This air stream is intended to create a pulsing separating and lifting action of the hair to be dried. It is a disadvantage in this arrangement that the respective opposed inclinations of the rectangularly disposed vane involve a complex rotor manufacture, necessitating an intricately shaped injection mold, because these parts are formed by high volume injection molding techniques. Equally, these inclined surfaces of the perpendicularly disposed vane add to the weight of the rotor, thus making more difficult the drive of the rotor in particular in a low-dimensioned hair dryer as regards the volumetric rate of air flow. In addition, in this pulsator configuration the pulsation frequency is not selectively adjustable, that is, variable, which is a serious disadvantage for the user.

SUMMARY OF INVENTION

It is therefore an object of the present invention to improve upon a known pulsator to the effect that the rotor affords ease of construction in a straightforward way and that the air stream exiting from the pulsator is variable.

This object is accomplished in that there is arranged upstream of the rotor, as seen when looking in the discharge direction of the air stream, a stator provided with movable vanes for varying the pulsation frequency and adapted to impart rotation to the air stream abut its axis. The stator acts to orientate the air in a rotating path, whereby air effectively strikes the impeller driving the rotor, thereby creating the desired pulsing action. The movable vanes for varying the pulsation frequency enable the user to adjust the pulsation frequency to different intensities as required, with the attendant advantage of enabling the hair to be lifted and/or fluffed to a greater or lesser degree, depending on the thickness of the hair or the degree of drying. In a particular setting, the pulsation of the air stream is canceled entirely, thus enabling the hair dryer to be used in the conventional manner, without requiring the pulsator to be detached from the hair dryer. The rotor itself needs no additional special parts to generate the rotary motion, that is, the swirl in the air stream. Thus, a pulsator of this type is essentially suitable for use on any hair dryer, including hair dryers having a low volumetric rate of air flow, for producing a pulsing air stream and, moreover, it can be manufactured with relative ease.

Advantageously, the stator includes air-directing blades whose angular position relative to a longitudinal axis of the pulsator is variable. By varying the angular position of the air-directing blades relative to the pulsator axis, the intensity of the swirl imparted to the air stream is likewise varied, that is, the air stream is caused to rotate about its own axis at variable velocities, thus causing the rotor to rotate at equally variable velocities.

An adjustment possibility for the air-directing blades affording ease of construction is provided by arranging for each of the air-directing blades to be pivotally mounted on a spoke by bearing rings, with the spokes being preferably radially disposed within the tubular housing portion.

In an advantageous further feature, the air-directing blades have at one end thereof an arm resting in an aperture of the tubular housing portion and carrying a pin at its free end.

Advantageously, a cam ring having helically shaped slots is mounted on the tubular housing portion, which slots are engaged by the pins of the arms, with the cam ring being preferably axially located relative to a collar of the pulsator housing by means of an outer ring. When the user rotates the outer ring and thus the cam ring, the pins will slide within the helically shaped slots, thereby varying the angular position of the air-directing blades.

In another feature of the present invention, spring arms sliding with their free ends on a plane surface of the collar are integrally formed on the cam ring. This produces a friction brake preventing the unit comprised of cam ring and outer ring from rotating inadvertently, thus precluding an undesired variation of the angular position of the air-directing blades.

In an advantageous embodiment of the present invention, the impeller is configured as deflector blades and central rib member, and the deflector blades are arranged in the rotor in an essentially parallel relationship to each other. This arrangement of the deflector blades has the effect of deflecting the air stream from the longitudinal axis by a specified angle, with the axis of the air stream tracing the surface of a cone on rotation of the rotor.

By providing the deflector blades with an essentially equal curvature, the air stream is deflected in a uniform pattern nearly over the full cross-sectional area of the air outlet end.

In an advantageous further feature of the present invention, the impeller of the rotor is configured as spokes and rib member. The air stream provided with a swirl, that is, caused to perform a rotary motion about its axis, impinges upon the spokes and the rib member, thereby driving the rotor and being deflected.

Advantageously, the rotor is provided with a plate blocking an air outlet end partially and eccentrically. This enables the air stream to exit only through the remainder of the cross-sectional area, with the axis of the air stream lying approximately in the planar center of gravity of the remainder of the cross-sectional area, tracing a circular path on rotation of the rotor. Also in this feature, the adjustment of the air-directing blades and thus of the pulsation frequency can be accomplished in the manner previously described.

In an advantageous embodiment, the rotor has an axle preferably supported in two bearing bushings provided respectively on an air outlet screen and centrally between the spokes. This arrangement enables the rotor to rotate with ease, in addition to ensuring an accurate bearing function.

Further features, advantages and application possibilities of the present invention will become apparent from the subsequent description of the embodiments illustrated in more detail in the accompanying drawings. It will be understood that any single feature and any combination of single features described and/or represented by illustration form the subject-matter of the present invention, irrespective of their summarization in the claims and their back-references.

Figure 1:
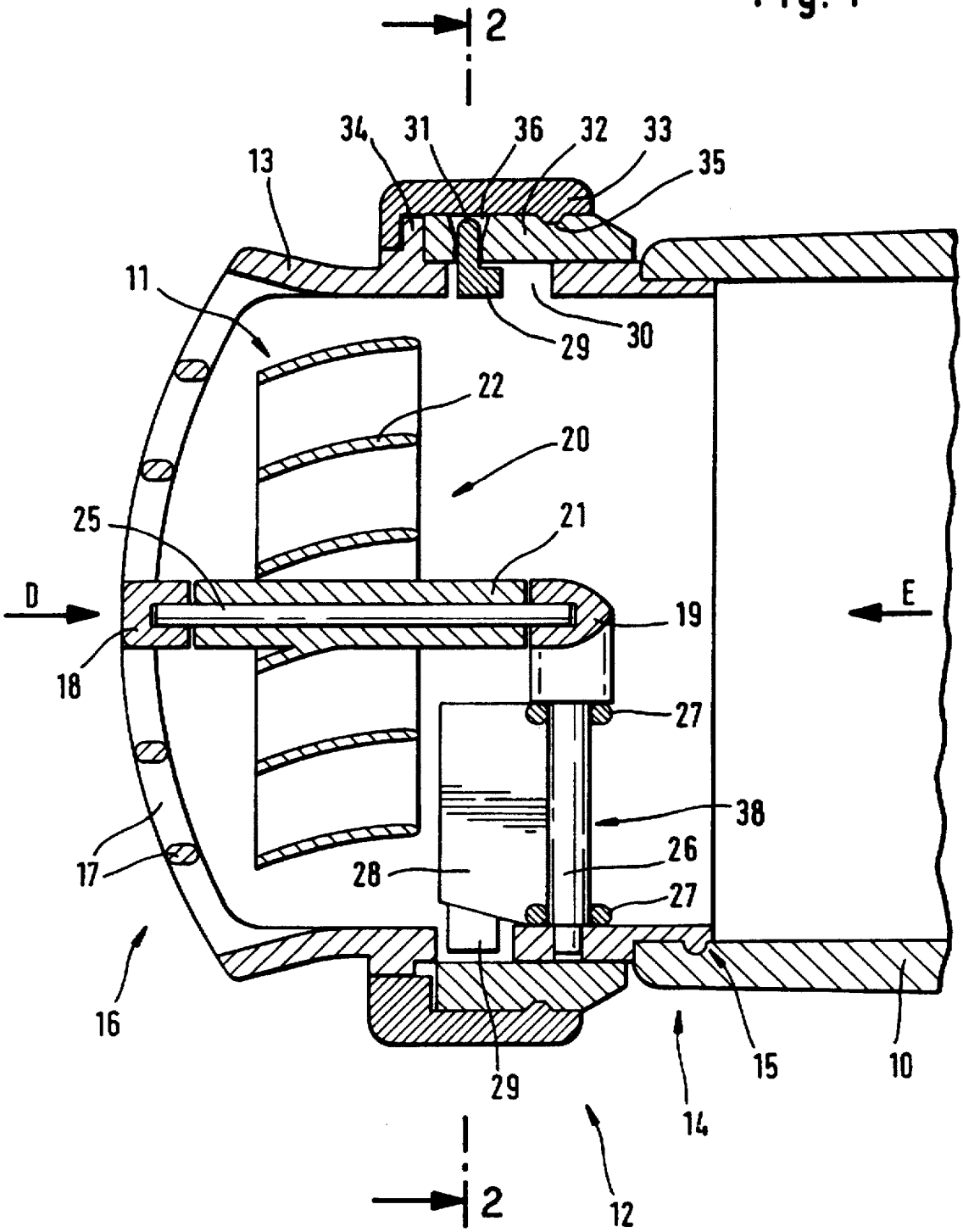
FIG. 1 is a longitudinal sectional view of the pulsator taken along the line B-B of FIG. 2.

To produce a pulsating air stream, a pulsator 12 may be coupled to a hair dryer 10 (illustrated only in part). To this end, a tubular housing portion 13 has fastening detent 15 at an air inlet end 14 by means of which a releasable attachment of the pulsator 12 to the hair dryer 10 can be accomplished. At the air outlet end 16, an air outlet screen 17 covers the essentially tubular housing portion 13 defining the pulsator housing. The rotor 20 for producing the pulsating air stream includes a hub 21 receiving therein an axle 25 fabricated from steel. Functioning as impeller 11, deflector blades 22 are provided which, extending in an essentially parallel relationship to each other, are disposed within an annular segment 23 (FIG. 4) and are of approximately like curvature. Arranged upstream of the rotor 20, as seen when looking in the direction of the air outlet end 16, is a stator 38 having spokes 26. An air-directing blade 28 is pivotally mounted on each spoke 26 by means of bearing rings 27. Provided at the outer end of each air-directing blade 28 is an arm 29 resting in a respective aperture 30 of the tubular housing portion 13. In this arrangement, the arms 29 are curved such as to follow the curvature of the tubular housing portion 13. Integrally formed at the free ends of the arms 29 is a respective pin 31 arranged to extend into a helically shaped slot 36 of a cam ring 32. The cam ring 32 is covered at least in part by an outer ring 33 and securely located by this ring relative to a collar 34 of the tubular housing portion 13. Preferably, the outer ring 33 and the cam ring 32 are connected with each other by locking catch 35.

Figure 4:
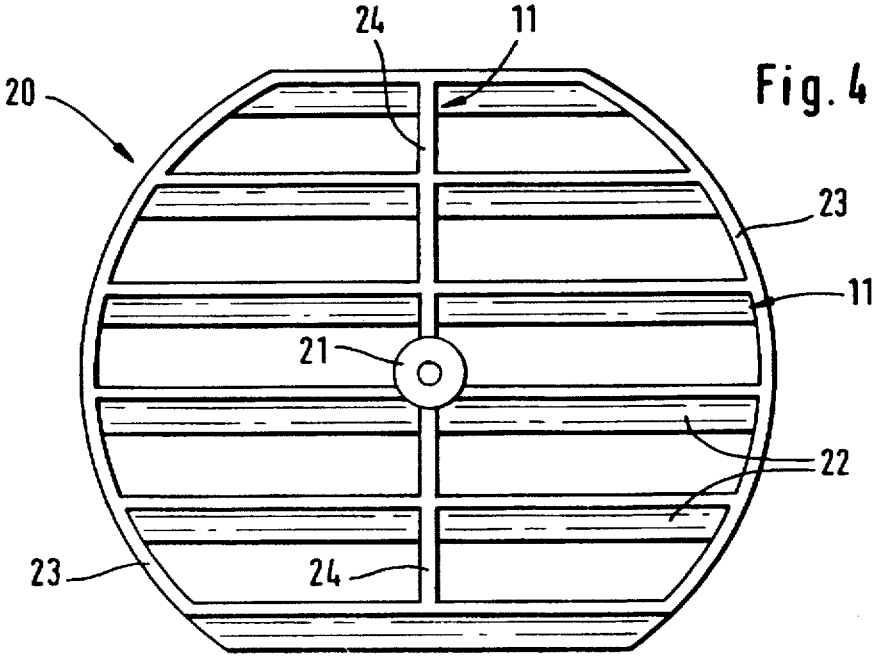
FIG. 4 is a view of the rotor as seen when looking in the direction E of FIG. 1.
Figure 5:
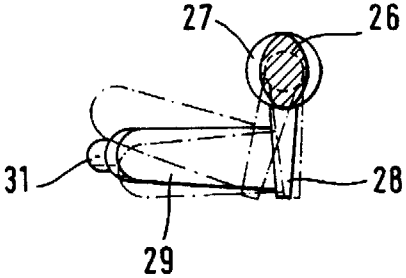
FIG. 5 is a cross-sectional view of a spoke taken along the line C—C of FIG. 2.

The rotor 20 is preferably supported in two bearing bushings 18, 19 provided respectively on the air outlet screen 17 and centrally between the spokes 26. With suitable constructional changes being made, the possibility also exists to use one bearing bushing for support. Any air exiting the hair dryer 10 in the direction of the air outlet end 16 first impacts the spokes 26 with their air-directing blades 28. When the user rotates the outer ring 33, thereby varying on the cam ring 32 the angular position of the air-directing blades 28 relative to the longitudinal axis of the pulsator 12 such that it deviates from zero value, a swirl is imparted to the air stream. This air stream acts on the deflector blades 22 and the central rib member 24 (FIG. 4) which correspond to the impeller 11, causing the rotor 20 to rotate. Depending on the amount of deviation of the angular position from zero, the intensity of the swirl and thus necessarily the rotational frequency of the rotor 20 vary. The deflector blades 22 deflect the air such that the axis of the air stream traces the surface of a cone. The exiting air stream varies its position continually. As a result, the area impacted by it for drying varies equally continually. This is perceived as pulsation by the user. This phenomenon creates a spreading and lifting action of the hair to be dried, this action being particularly effective with short and mid-long hair, while overall allowing an advantageous and gentle as well as more rapid drying of any length of hair. Using a rotary motion on the outer ring 33, the user is thus in a position to vary the angular position of the air-directing blades 28 and thereby vary the pulsation frequency, depending on whether a strong or a weak pulsation of the air stream is desired. The pivot angle of the air-directing blades 28 is preferably in a range of between −5° and +15° relative to zero position (FIG. 5). In a base position in which the angle of the air-directing blades 28 relative to the longitudinal axis of the pulsator is zero, the pulsation frequency is equally zero, and the hair dryer 10 acts approximately in the manner of a device without pulsator 12. This thus also enables hair dryers with integral pulsator to be manufactured, since it is possible to selectively create a pulsating and a non-pulsating air stream without any changes to the device being required.

Figure 2:
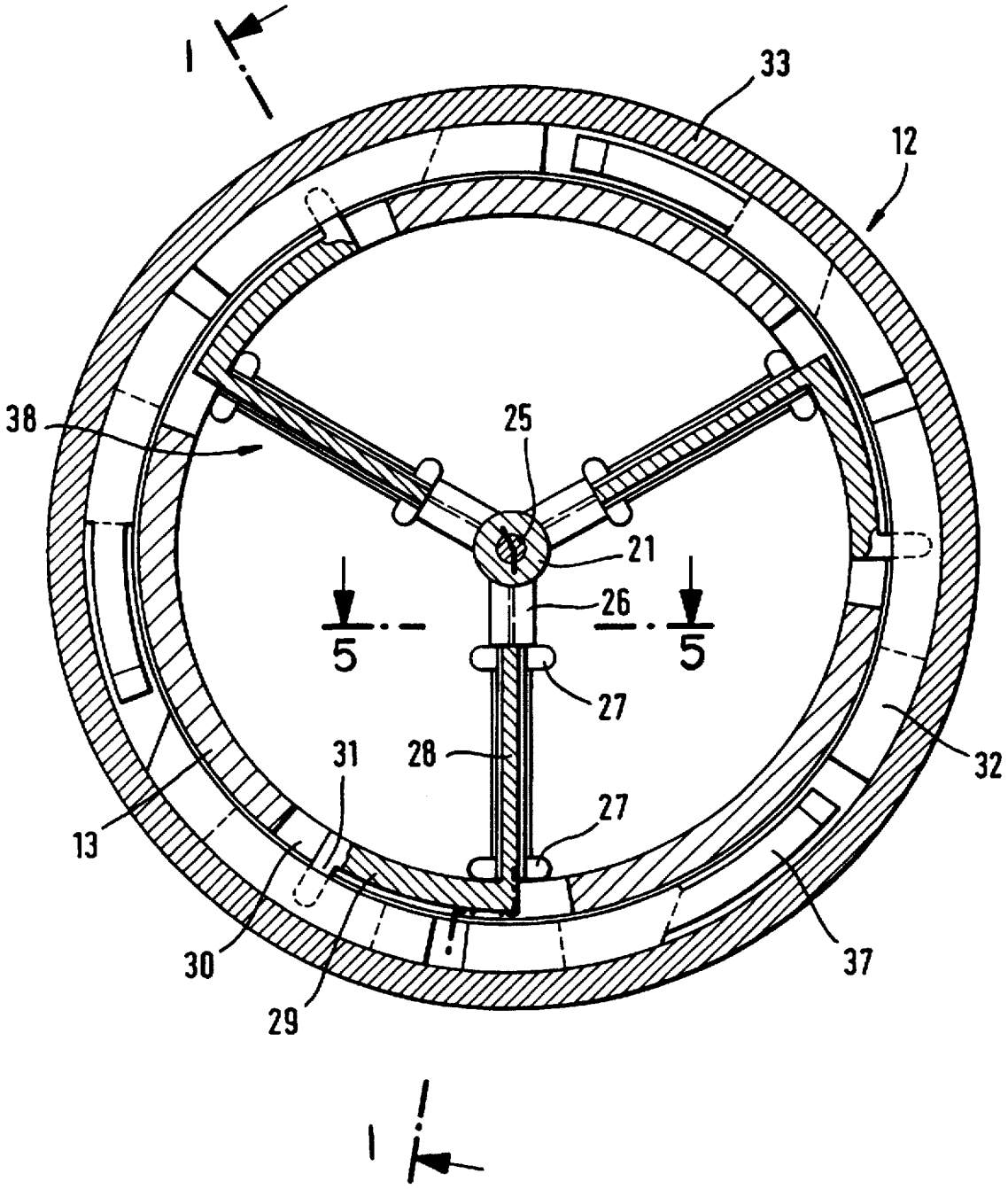
FIG. 2 is a cross-sectional view of the pulsator taken along the line A—A of FIG. 1, showing the cam ring non sectioned.

FIG. 2 shows a sectional view of the pulsator 12. The stator 38 preferably has three spokes 26 arranged radially. Inserted in the hub 21 centrally between the spokes 26 is the axle 25 of the rotor 20. By means of bearing rings 27, the spokes 26 carry the air-directing blades 28 having at their outer ends the arms 29 projecting with their pins 31 into the apertures 30 of the tubular housing portion 13. The tubular housing portion 13 is covered by the cam ring 32 on which spring arms 37 are integrally formed. These spring arms 37 have their free ends in sliding engagement with a plane surface of a collar 34 of the tubular housing portion 13 (FIG. 1), thereby creating a friction brake that prevents the outer ring 33 as well as the cam ring 32 from rotating inadvertently, thus eliminating the risk for the angular position of the air-directing blades 28 to be varied during manipulation independently of the user.

Figure 3:
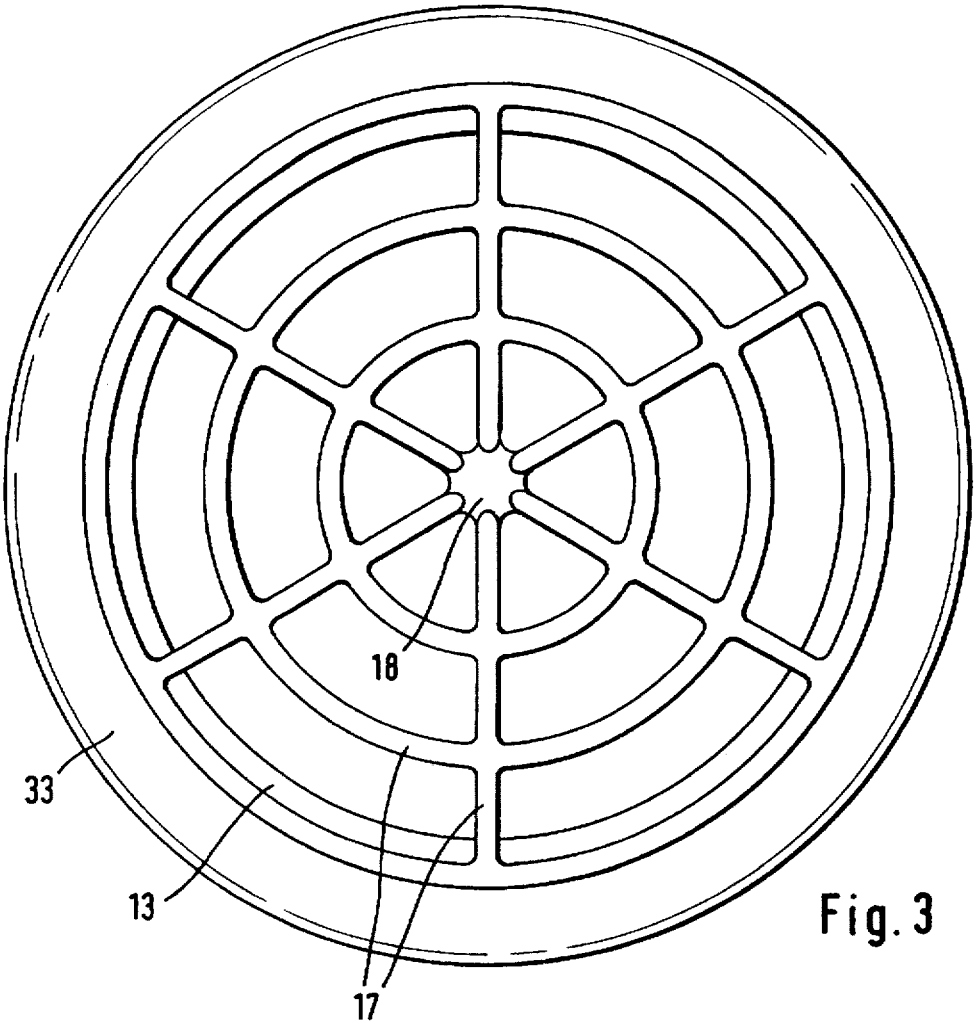
FIG. 3 is a view of the pulsator as seen when looking in the direction D of FIG. 1.

The air outlet screen 17 covering the pulsator 12 at one end thereof has in its center the bearing bushing 18, FIG. 3. According to FIG. 4, the rotor 20 arranged in the pulsator 12 immediately behind the air outlet screen 17 is comprised of a sleeve configured as an annular segment 23 having a central rib member 24 operating as a portion of the impeller 11, with the annular segment 23 being of a flattened configuration at diametrically opposite sections. The hub 21 is provided centrally in the rotor 20. Clearly recognizable are the impeller 11 in the form of deflector blades 22 extending parallel to each other and curved in approximately like shape, with the curvature appearing as a surface of substantially equal size in the front view, as well as the central rib member 24 (FIG. 4).

Figure 6:
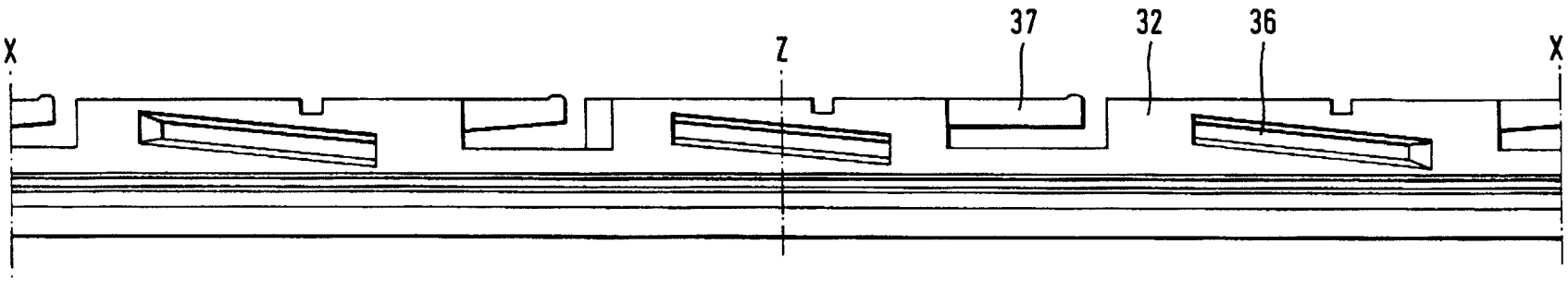
FIG. 6 is a developed view of the cam ring with reference to FIG. 2.

The variation of the angular position of the air-directing blades 28 will become clear when viewing the FIGS. 5 and 6. The cylindrical portion of the spokes 26 is enclosed by the bearing rings 27 in which the air-directing blades 28 are pivotally mounted. On rotation of the cam ring 32, the pin 31 disposed on the arm 29 varies its position relative to the tubular housing portion 13 since it slides within the helically shaped slots 36 of the cam ring 32. By varying its position relative to the tubular housing portion 13, the pin 31 effects a variation of the angular position of the air-directing blades 28. The spring arms 37 integrally formed on the cam ring 32 slide on a plane surface of the collar 34 (FIG. 1). They provide a friction brake, thereby preventing the undesired effect of the rings 32, 33 (FIG. 1) being rotated back and an inadvertent variation of the angular position of the air-directing blades 28 independently of the user.

Figure 7:
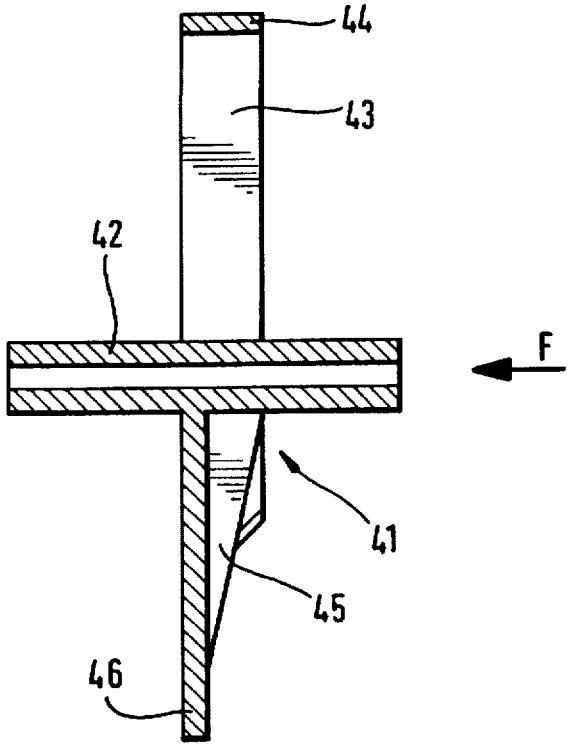
FIG. 7 is a longitudinal sectional view of the rotor illustrating a second embodiment thereof.
Figure 8:
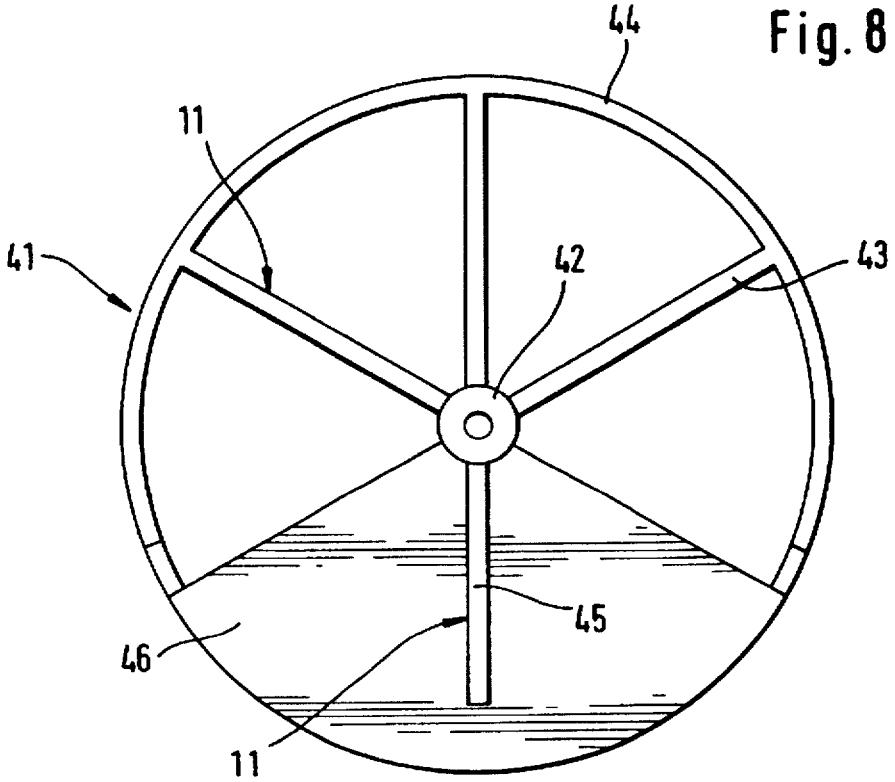
FIG. 8 is a view of the rotor as seen when looking in the direction F of FIG. 7.

In a second embodiment as illustrated in FIGS. 7 and 8, a rotor 41 is comprised of an annular segment 44 with a hub 42 serving to rotatably support the rotor structure 41 as in the first embodiment. Preferably three spokes 43 are approximately equally spaced apart in the annular segment 44. Provided opposite the spokes 43 is a plate 46 blocking the cross-sectional area of air discharge partially and eccentrically. Provided approximately centrally on the plate 46 is a rib member 45. When an air stream is directed in the direction of the air outlet end 16, a swirl will be imparted to it through the stator 38 arranged upstream of the rotor 41 as in the first embodiment, the air stream then impinging with this swirl on the impeller means 11, that is, the spokes 43 and the rib member 45. This air stream effects rotation of the rotor 41, with the plate 46 covering part of the cross-sectional area of air discharge, thus creating a pulsating effect in the exiting air. The adjustment of the angular position of the air-directing blades 28 for varying the rotor rotational frequency and thus the pulsation frequency is made as in the first embodiment.

We claim:

1. An air-moving pulsator for a hair dryer, said pulsator comprising:

a housing having a sleeve-like body portion having an air inlet portion and an air outlet portion and defining an air passageway having a longitudinal axis therebetween, a rotor rotatably supported in said housing, said rotor further comprising an impeller adapted to be impacted by an air stream from the hair dryer and a stator provided in said housing on an air inlet side of said rotor, said stator further comprising at least one moveable plate selectively partially occluding the air stream to deflect the air stream to a selected angle relative to said longitudinal axis, whereby said stator imparts rotation about said longitudinal axis to the air stream impacting said impeller to move said rotor at a desired pulsation frequency, thereby causing a pulsing action in the air stream exiting said air outlet portion.

2. An air-moving pulsator as claimed in claim 1, wherein said at least one moveable plate further comprises a plurality of air-directing blades positionable to selected angles relative to a plane normal to said longitudinal axis.

3. An air-moving pulsator as claimed in claim 2, wherein at least one of said air-directing blades is pivotally mounted on a spoke by at least one bearing ring.

4. An air-moving pulsator as claimed in claim 3, wherein said spokes are radially disposed within said housing.

5. An air-moving pulsator as claimed in claim 4, further comprising at least three air-directing blades pivotally mounted respectively on at least three said radially disposed spokes.

6. An air-moving pulsator as claimed in claim 2 wherein said housing body portion further defines an aperture formed in the body portion sleeve and said air-directing blades further comprise at a peripheral region thereof an arm carrying a pin at a remote end of said arm, said arm being disposed in said housing aperture.

7. An air-moving pulsator as claimed in claim 6, further comprising a cam ring mounted on said housing body portion and having camming slots extending simultaneously in an axial and radial direction relative to the longitudinal axis, said slots camming the pins of the arms.

8. An air-moving pulsator as claimed in claim 7, wherein said camming slots are helically shaped.

9. An air-moving pulsator as claimed in claim 7, further comprising an outer ring mounted on said housing and wherein said housing body portion further comprises a collar, said outer ring axially positioning said cam ring relative to said collar.

10. An air-moving pulsator as claimed in claim 9, wherein said cam ring further comprises at least one spring arm having a free end biased against a surface of the collar, thereby exerting a retarding force against inadvertent movement of said cam ring.

11. An air-moving pulsator as claimed in claim 2, wherein said air-directing blades are positionable at angles up to about 15° to the normal plane.

12. An air-moving pulsator as claimed in claim 2, wherein said air-directing blades are positionable at angles within a range of from about −5° up to about +15° to the normal plane.

13. An air-moving pulsator as claimed in claim 1, wherein the impeller further comprises a plurality of deflector blades and at least one rib member, and wherein at least of portion of said plurality of deflector blades is arranged essentially parallel to each other.

14. An air-moving pulsator as claimed in claim 13, wherein the deflector blades of said portion are provided with an essentially equal curvature.

15. An air-moving pulsator as claimed in claim 1, wherein the impeller further comprises a plurality of impeller spokes and at least one rib member (45).

16. An air-moving pulsator as claimed in claim 1, wherein the rotor further comprises a plate occluding said air outlet portion partially and eccentrically.

17. An air-moving pulsator as claimed in claim 1, wherein the rotor further comprises an axle rotatably supported in a bearing bushing provided on said stator.

18. An air-moving pulsator as claimed in claim 17, wherein said housing further comprises an air outlet grille in register with said air outlet portion, said air outlet grille comprising a second beating bushing rotatably supporting said rotor axle.

19. An air-moving pulsator as claimed in claim 1, wherein an axis of rotation of said rotor is parallel to said longitudinal axis.

20. An air-moving pulsator as claimed in claim 1 in combination with said hair dryer.

21. An air-moving pulsator for a hair dryer, said pulsator comprising:

a housing having a sleeve-like body portion having an air inlet portion and an air outlet portion and defining an air passageway having a longitudinal axis therebetween, a stator provided in said housing, a rotor rotatably supported by said stator, said rotor further comprising an impeller adapted to be impacted by an air stream from the hair dryer, wherein said stator further is provided in said housing on an air inlet side of said rotor, said stator further comprising a plurality of moveable blades having an angular position relative to said longitudinal axis being selectively variable, said moveable blades partially occluding the air stream, whereby said stator imparts rotation about said longitudinal axis to the air stream impacting said impeller to move said rotor at a desired pulsation frequency, thereby causing a pulsing action in the air stream exiting said air outlet portion.

22. An air-moving pulsator as claimed in claim 21, wherein said moveable blades are moveable to selected angles relative to a plane normal to said longitudinal axis.

23. An air-moving pulsator as claimed in claim 22, wherein said air-directing blades are pivotally mounted on spokes.

24. An air-moving pulsator as claimed in claim 23, wherein said spokes are radially disposed within said housing.

25. An air-moving pulsator as claimed in claim 23, further comprising at least three air-directing blades pivotally mounted respectively on at least three said spokes.

26. An air-moving pulsator as claimed in claim 22, wherein said air-directing blades are positionable at angles up to about 15° to the normal plane.

27. An air-moving pulsator as claimed in claim 22, wherein said air-directing blades are positionable at angles within a range of from about −5° up to about +15° to the normal plane.

28. An air-moving pulsator as claimed in claim 21, further comprising:

said housing body portion further defining an aperture formed in the body portion, said air-directing blades further comprising at a peripheral region thereof a respective arm carrying a pin at a remote end of said arm, said arm being disposed in said housing aperture, and a cam ring mounted on said housing body portion and having helically shaped camming slots, said slots camming said pins of said arms.

29. An air-moving pulsator as claimed in claim 28, wherein said housing body portion further comprises a collar axially positioning said cam ring relative thereto, and said cam ring further comprises at least one spring arm having a free end biased against a surface of the collar, thereby exerting a retarding force against inadvertent movement of said cam ring.

30. An air-moving pulsator as claimed in claim 21, wherein an axis of rotation of said rotor is parallel to said longitudinal axis.

31. An air-moving pulsator as claimed in claim 21 in combination with said hair dryer.

* * * * *